US011343615B2

(12) United States Patent
Ruan

(10) Patent No.: US 11,343,615 B2
(45) Date of Patent: May 24, 2022

(54) SOUND PRODUCING STRUCTURE AND TERMINAL

(71) Applicant: VIVO MOBILE COMMUNICATION CO., LTD., Guangdong (CN)

(72) Inventor: Qingbo Ruan, Dongguan (CN)

(73) Assignee: VIVO MOBILE COMMUNICATION CO., LTD., Guangdong (CN)

( * ) Notice: Subject to any disclaimer, the term of this patent is extended or adjusted under 35 U.S.C. 154(b) by 0 days.

(21) Appl. No.: 17/158,058

(22) Filed: Jan. 26, 2021

(65) Prior Publication Data

US 2021/0152943 A1 May 20, 2021

Related U.S. Application Data

(63) Continuation of application No. PCT/CN2019/097223, filed on Jul. 23, 2019.

(30) Foreign Application Priority Data

Jul. 26, 2018 (CN) ..... 201810833879.6

(51) Int. Cl.
*H04R 9/02* (2006.01)
*H04R 9/06* (2006.01)
*H04R 7/00* (2006.01)

(52) U.S. Cl.
CPC ..... *H04R 9/025* (2013.01); *H04R 9/06* (2013.01); *H04R 7/00* (2013.01); *H04R 2400/11* (2013.01)

(58) Field of Classification Search
CPC ..... H04R 1/24
See application file for complete search history.

(56) References Cited

U.S. PATENT DOCUMENTS

2002/0168074 A1 11/2002 Miyamoto et al.
2008/0317255 A1* 12/2008 Cozens ..... H04R 9/10 381/71.6

(Continued)

FOREIGN PATENT DOCUMENTS

CN 1568070 A 1/2005
CN 1886005 A 12/2006

(Continued)

OTHER PUBLICATIONS

International Search Report and Written Opinion of the International Searching Authority regarding International Patent Application No. PCT/CN2019/097223, dated Sep. 30, 2019. Translation provided by Bohui Intellectual Property.

(Continued)

*Primary Examiner* — Angelica M McKinney
(74) *Attorney, Agent, or Firm* — Harness, Dickey & Pierce, P.L.C.

(57) ABSTRACT

A sound producing structure includes: a frame body, a magnetic circuit system, a first diaphragm, and a second diaphragm. The frame body includes a receiving cavity, and the receiving cavity includes a first opening and a second opening that are located on two opposite sides of the frame body. The magnetic circuit system is located in the receiving cavity, and the magnetic circuit system includes a first magnetic channel and a second magnetic channel that are isolated from each other. The first diaphragm is disposed facing the first opening, a first voice coil is disposed on the first diaphragm, and a portion of the first voice coil extends into the first magnetic channel. The second diaphragm is disposed facing the second opening, a second voice coil is disposed on the second diaphragm, and a portion of the second voice coil extends into the second magnetic channel.

9 Claims, 1 Drawing Sheet

(56) References Cited

U.S. PATENT DOCUMENTS

| | | | | |
|---|---|---|---|---|
| 2012/0128195 | A1 | 5/2012 | Liu et al. | |
| 2015/0139479 | A1* | 5/2015 | Lai | H04R 9/025 381/412 |
| 2021/0152944 | A1* | 5/2021 | Ruan | H04R 9/025 |

FOREIGN PATENT DOCUMENTS

| | | | | |
|---|---|---|---|---|
| CN | 201131055 | Y | | 10/2008 |
| CN | 203039891 | U | | 7/2013 |
| CN | 203219365 | | * | 9/2013 |
| CN | 204119458 | U | | 1/2015 |
| CN | 205283802 | U | | 6/2016 |
| CN | 106162457 | A | | 11/2016 |
| CN | 107071669 | A | * | 8/2017 |
| CN | 109040920 | A | | 12/2018 |
| DE | 2709972 | A1 | | 9/1978 |
| JP | 2002058094 | | * | 2/2002 |

OTHER PUBLICATIONS

First Office Action regarding Chinese Patent Application No. 201810833879.6, dated Dec. 24, 2019. Translation provided by Bohui Intellectual Property.

Second Office Action regarding Chinese Patent Application No. 201810833879.6, dated Sep. 15, 2020. Translation provided by Bohui Intellectual Property.

Supplementary European Search Report regarding International Application No. 19841793.3-1210/3826325 PCT/CN2019/097223, dated Jul. 26, 2021.

* cited by examiner

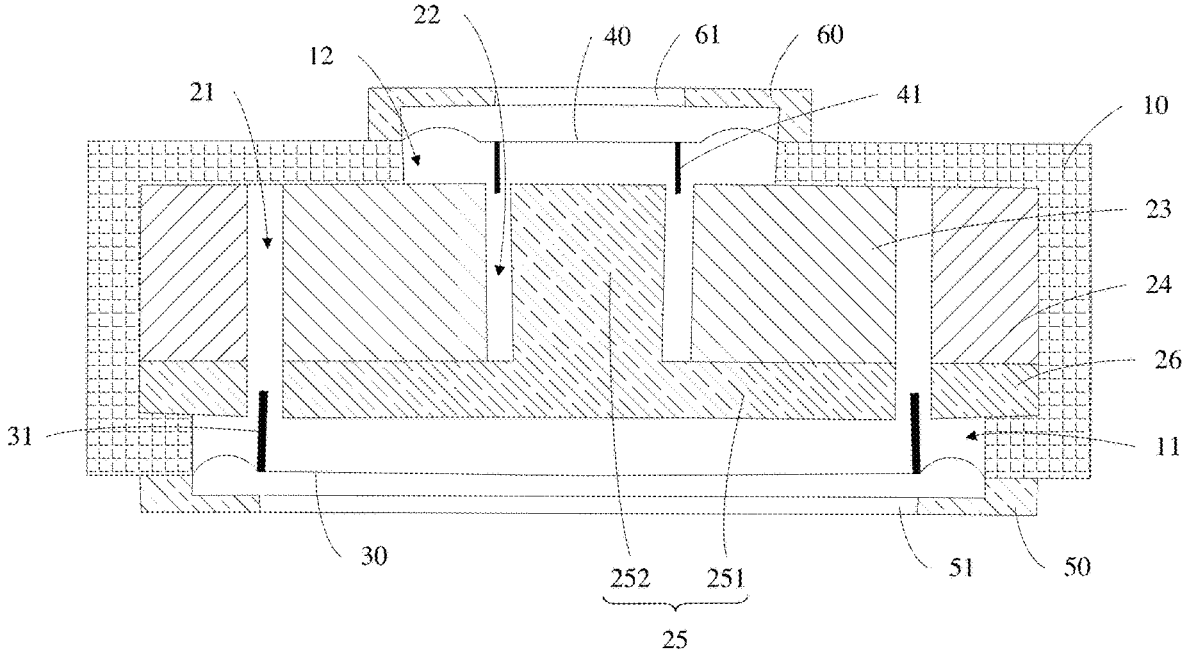
22
40
61
60
12
21
41
10
23
24
26
31
11
30
252
251
51
50
25

SOUND PRODUCING STRUCTURE AND TERMINAL

CROSS-REFERENCE TO RELATED APPLICATIONS

This application is a Bypass Continuation Application of PCT/CN2019/097223 filed on Jul. 23, 2019, which claims priority to Chinese Patent Application No. 201810833879.6 filed on Jul. 26, 2018, which are incorporated herein by reference in their entirety.

TECHNICAL FIELD

Some embodiments of the present disclosure relate to the field of communications technologies, and more particularly to a sound producing structure and a terminal.

BACKGROUND

At present, an arrangement of a receiver of a dual-face screen terminal mainly includes two manners. A first manner is to set a main screen, and then set a receiver on a side where the main screen is located for the use of a user; a second manner is to set both screens as main screens, and then set a receiver respectively for the use of a user. However, for the first manner, a function of the receiver is realized only when the user faces the side where the main screen is located, which causes that the user needs to first turn the terminal to the side where the main screen is located each time the user uses the receiver. For the second manner, although a problem of turning over the screen during use may be avoided by providing two receivers, providing two receivers needs space for the arrangement of the two receivers, which affects space for installing other functional components.

As will be seen, in the related art, an arrangement of double receivers has a problem of occupying a large space.

SUMMARY

Some embodiments of the present disclosure provide a sound producing structure and a terminal, so as to solve a problem that an arrangement of double receivers occupies a large space in the related art.

Some embodiments of the present disclosure provide a sound producing structure. The sound producing structure includes:

a frame body, wherein the frame body includes a receiving cavity, and the receiving cavity includes a first opening and a second opening that are located on two opposite sides of the frame body;

a magnetic circuit system, wherein the magnetic circuit system is located in the receiving cavity, and the magnetic circuit system includes a first magnetic channel and a second magnetic channel that are isolated from each other;

a first diaphragm, wherein the first diaphragm is disposed facing the first opening, a first voice coil is disposed on the first diaphragm, and a portion of the first voice coil extends into the first magnetic channel; and a second diaphragm, wherein the second diaphragm is disposed facing the second opening, a second voice coil is disposed on the second diaphragm, and a portion of the second voice coil extends into the second magnetic channel.

Some embodiments of the present disclosure further provide a terminal, and the terminal includes the foregoing sound producing structure.

In this way, in some embodiments of the present disclosure, the sound producing structure includes: a frame body, wherein the frame body includes a receiving cavity, and the receiving cavity includes a first opening and a second opening that are located on two opposite sides of the frame body; a magnetic circuit system, wherein the magnetic circuit system is located in the receiving cavity, and the magnetic circuit system includes a first magnetic channel and a second magnetic channel that are isolated from each other; a first diaphragm, wherein the first diaphragm is disposed facing the first opening, a first voice coil is disposed on the first diaphragm, and a portion of the first voice coil extends into the first magnetic channel; and a second diaphragm, wherein the second diaphragm is disposed facing the second opening, a second voice coil is disposed on the second diaphragm, and a portion of the second voice coil extends into the second magnetic channel. In this way, by providing a sound producing structure capable of producing sound on both sides, occupying space of the sound producing structure in the terminal may be effectively reduced.

BRIEF DESCRIPTION OF THE DRAWINGS

FIG. 1 is a schematic diagram showing a structure of a sound producing structure, in accordance with an embodiment of the present disclosure.

DETAILED DESCRIPTION

Technical solutions in some embodiments of the present disclosure will be described clearly and completely with reference to accompanying drawings in some embodiments of the present disclosure. Obviously, the described embodiments are merely some but not all embodiments of the present disclosure. All other embodiments obtained on a basis of embodiments of the present disclosure by a person of ordinary skill in the art without paying any creative effort shall be included in the protection scope of the present disclosure.

As shown in FIG. 1, some embodiments of the present disclosure provide a sound producing structure. The sound producing structure includes the following components.

A frame body 10 includes a receiving cavity. The receiving cavity includes a first opening 11 and a second opening 12 that are located on two opposite sides of the frame body 10.

A magnetic circuit system is located in the receiving cavity, and the magnetic circuit system includes a first magnetic channel 21 and a second magnetic channel 22 that are isolated from each other.

A first diaphragm 30 is disposed facing the first opening 11, and a first voice coil 31 is disposed on the first diaphragm 30, and a portion of the first voice coil 31 extends into the first magnetic channel 21.

And a second diaphragm 40 is disposed facing the second opening 12. A second voice coil 41 is disposed on the second diaphragm 40, and a portion of the second voice coil 41 extends into the second magnetic channel 22.

In this embodiment, the frame body 10 is provided with the magnetic circuit system including the first magnetic channel 21 and the second magnetic channel 22 that are isolated from each other, and the first diaphragm 30 and the first voice coil 31 are disposed correspondingly to the first magnetic channel 21, so that the sound producing structure may produce sound on a side where the first opening 11 of the frame body 10 is located, that is, a first sound producing system is formed on the side where the first opening 11 is located. The second diaphragm 40 and the second voice coil 41 are disposed correspondingly to the second magnetic channel 22, so that the sound producing structure may produce sound on a side where the second opening 12 of the frame body 10 is located, that is, a second sound producing system is formed on the side where the second opening 12 is located, so that the sound producing structure may produce sound on both sides. In addition, since the first magnetic channel 21 and the second magnetic channel 22 are isolated from each other, the sound producing system formed correspondingly to the first magnetic channel 21 and the sound producing system formed correspondingly to the second magnetic channel 22 will not interfere with each other, which improves a sound producing effect of the sound producing structure.

The sound producing structure may be a receiver or a loudspeaker, and a size and a model of the sound producing structure may be designed according to actual needs, which is not limited herein.

In this way, for a terminal needing to produce sound on both sides, the terminal may produce sound on both sides by providing the sound producing structure capable of producing sound on both sides. Compared with the related art in which the receivers or loudspeakers are required to be disposed on a front face and a back face of the terminal respectively, a problem that an arrangement of double receivers or double loudspeakers occupies a large space may be effectively solved.

The first diaphragm 30 and the first voice coil 31 may be fixed together by adhesion, so that the first diaphragm 30 may vibrate along with the first voice coil 31, which will make the sound producing structure produce sound on the side where the first opening 11 is located. There is a magnetic field loop in the first magnetic channel 21. In this way, when an electrical signal passes through the first voice coil 31, under action of the magnetic field loop, the first voice coil 31 partially located in the first magnetic channel 21 will vibrate, which will drive the first diaphragm 30 to vibrate and further make the sound producing structure produce sound on the side where the first opening 11 is located.

Similarly, the second diaphragm 40 and the second voice coil 41 may be fixed together by adhesion, so that the second diaphragm 40 may vibrate along with the second voice coil 41, which will make the sound producing structure produce sound on the side where the second opening 12 is located. There is a magnetic field loop in the second magnetic channel 22. In this way, when an electrical signal passes through the second voice coil 41, under the action of the magnetic field loop, the second voice coil 41 partially located in the second magnetic channel 22 will vibrates, which will drive the second diaphragm 40 to vibrate and further make the sound producing structure produce sound on the side where the second opening 12 is located.

The frame body 10 is a supporting structure of the whole sound producing structure, and may be injection molded by a plastic material. Heat dissipation air holes may be disposed on a side wall of the frame body 10 to dissipate heat of the magnetic circuit system, the first voice coil 31 and the second voice coil 41, thereby avoiding a problem that the temperature of the magnetic circuit system, the first voice coil 31 and the second voice coil 41 is too high during the working process of the sound producing structure.

Optionally, the magnetic circuit system includes a first magnet 23, a second magnet 24 and a yoke 25.

The first magnet 23 is annular, and a through hole 231 is disposed in the middle region of the first magnet 23.

The second magnet 24 is disposed around a periphery of the first magnet 23, and there is a gap between the first magnet 23 and the second magnet 24 to form the first magnetic channel 21.

One portion of the yoke 25 abuts against a side of the first magnet 23 facing the first diaphragm 30, another portion of the yoke 25 is located in the through hole 231. There is a gap between the another portion of the yoke 25 and an inner side wall of the through hole 231 to form the second magnetic channel 22, and the first magnetic channel 21 and the second magnetic channel 22 are isolated by the yoke 25.

In this embodiment, the first magnet 23 is connected to an inner wall of the receiving cavity on the side where the second opening 12 is located, and the first magnet 23 may be fixedly disposed in the receiving cavity by adhesion. The second magnet 24 is attached to an inner side wall of the receiving cavity between the first opening 11 and the second opening 12, and the second magnet 24 may be fixedly disposed in the receiving cavity by adhesion or clamping.

The second magnet 24 may be formed integrally or formed by combining a plurality of sub-magnets. For the integrally formed second magnet 24, an accommodating groove for accommodating the first magnet 23 needs to be provided; and for the second magnet 24 formed by combining a plurality of sub-magnets, the first magnet 23 is required to be enclosed. Magnetic poles of the first magnet 23 and the second magnet 24 are opposite, so that the gap between the first magnet 23 and the second magnet 24 forms the first magnetic channel 21.

The yoke 25 may be fixed to the first magnet 23 by a manner of magnetic attraction, or the yoke 25 may be fixed to the first magnet 23 by a manner of magnetic force combined with adhesion. It will be noted that, compared with the fixing only through magnetic force, through the manner of magnetic force combined with adhesion, the yoke 25 and the first magnet 23 may be effectively prevented from relative displacement during a shaking process of the sound producing structure, thereby avoiding affecting the sound producing effect of the whole sound producing structure.

The through hole 231 is disposed in the middle region of the first magnet 23, and a portion of the yoke 25 is located in the through hole 231 and a gap exists between the portion of the yoke 25 and the inner side wall of the through hole 231 to form the second magnetic channel 22.

The magnetic circuit system further includes a magnetic conductive sheet 26. The magnetic conductive sheet 26 is connected to a side of the second magnet 24 facing the first diaphragm 30, and a gap exists between the magnetic conductive sheet 26 and the yoke 25 to form the first magnetic channel 21. By providing the magnetic conductive sheet 26, a gathering degree of a magnetic flux in the first magnetic channel 21 may be improved, and thus a vibration effect of the first voice coil 31 may be improved.

Optionally, the yoke 25 is a T-shaped yoke and includes a horizontal portion 251 and a vertical portion 252. The horizontal portion 251 abuts against a side of the first magnet 23 facing the first diaphragm 30, the vertical portion 252 is located in the through hole 231, and the first magnetic channel 21 and the second magnetic channel 22 are isolated by the horizontal portion 251.

In this embodiment, by arranging the yoke 25 in a T shape, forming the first magnetic channel 21 and the second magnetic channel 22 respectively, and isolating the first magnetic channel 21 and the second magnetic channel 22 through the horizontal portion 251, i.e., separating the magnetic circuit system into two portions that do not interfere with each other, the first diaphragm 30 disposed on the side where the first opening 11 is located and the second diaphragm 40 disposed on the side where the second opening 12 is located are ensured not to interfere with each other during the working process, thereby improving the sound producing effect of the sound producing structure.

Optionally, the sound producing structure further includes a first cover body 50 and a second cover body 60.

The first cover body 50 covers the first opening 11, the first diaphragm 30 is located between the first cover body 50 and the receiving cavity, and the first cover body 50 is provided with a first sound outlet hole 51 corresponding to the first diaphragm 30.

The second cover body 60 covers the second opening 12, the second diaphragm 40 is located between the second cover body 60 and the receiving cavity, and the second cover body 60 is provided with a second sound outlet hole 61 corresponding to the second diaphragm 40.

In this embodiment, by providing the first cover body 50 and the second cover body 60, the first diaphragm 30 and the second diaphragm 40 may be protected, and a damage to the first diaphragm 30 and the second diaphragm 40 caused by external objects is reduced. In addition, in an application to a whole machine, the sound producing structure may be assembled to and in contact to the whole machine through the first cover body 50 and the second cover body 60.

Moreover, in order to further protect the first diaphragm 30 and the second diaphragm 40, a first protective net may be disposed in the first sound outlet hole 51, and the first protective net may also play a dust-proof role, so as to prevent dust from covering the first diaphragm 30 and further affecting the sound producing effect of the first diaphragm 30; a second protective net may be disposed in the second sound outlet hole 61, the second protective net may also play a dust-proof role, so as to prevent dust from covering the second diaphragm 40 and further affecting the sound producing effect of the second diaphragm 40.

It will be noted that a structural shape of each component of the sound producing structure may be designed according to actual needs. For example, when the frame body 10 has a cubic structure, the first cover body 50 and the second cover body 60 may be arranged in a square shape; when the frame body 10 has a cylindrical structure, the first cover body 50 and the second cover body 60 may be arranged in a circular shape. Structural shapes of other components may also be set according to actual conditions, as long as the sound producing structure can produce sound on both sides.

Some embodiments of the present disclosure also relate to a terminal, and the terminal includes the foregoing sound producing structure.

The terminal further includes a controller. The controller is electrically connected to the first voice coil and the second voice coil, and the controller may control the first voice coil or the second voice coil to work according to a state of the terminal.

For example, for a dual-face screen terminal, a sensor may be used to detect which side of the terminal is used by a user to answer a call. In this way, an electric signal may be output to a corresponding voice coil by the controller to realize a conversation function, and a voice coil that does not receive an electric signal cannot produce sound, which reduces a risk of sound leakage in a conversation process.

In addition, for the sound producing structure located in the terminal, a first sound outlet channel corresponding to the first sound outlet hole may also be disposed in the terminal, and a second sound outlet channel corresponding to the second sound outlet hole may also be disposed in the terminal, so that the terminal may produce sound on both sides.

Optionally, the terminal is a dual screen terminal, such as a dual-face screen terminal, or a folding-screen terminal.

The terminal may also be a mobile phone, a tablet computer, a personal digital assistant (PDA), an e-book reader, a moving picture experts group audio layer III (MP3) player, a moving picture experts group audio layer IV (MP4) player, a laptop portable computer, a car-mounted computer, a desktop computer, a set-top box, an intelligent television, a wearable device, and the like.

It will be noted that an implementation of the embodiments of the above sound producing structure is also applicable to the embodiment of the terminal, and a same technical effect may be achieved, which will not be repeated herein.

The above description is only for the specific embodiments of the present disclosure, but the protection scope of the present disclosure is not limited thereto, and variations or substitutions within the technical scope of the present disclosure that any person skilled in the art may readily conceive of shall be included in the protection scope of the present disclosure. Therefore, the protection scope of the present disclosure shall be subject to the protection scope of the claims.

What is claimed is:

1. A sound producing structure, comprising:

a frame body, wherein the frame body includes a receiving cavity, and the receiving cavity includes a first opening and a second opening that are disposed on two opposite sides of the frame body;

a magnetic circuit system, wherein the magnetic circuit system is located in the receiving cavity, and the magnetic circuit system includes a first magnetic channel and a second magnetic channel that are isolated from each other;

a first diaphragm, wherein the first diaphragm is disposed facing the first opening, a first voice coil is disposed on the first diaphragm, and a portion of the first voice coil extends into the first magnetic channel;

and a second diaphragm, wherein the second diaphragm is disposed facing the second opening, a second voice coil is disposed on the second diaphragm, and a portion of the second voice coil extends into the second magnetic channel; wherein the magnetic circuit system includes a first magnet, a second magnet and a magnetic conductive sheet, the second magnet is disposed around a periphery of the first magnet, the magnetic conductive sheet is connected to a side of the second magnet facing the first diaphragm, and the first magnet is directly connected to an inner surface of a wall of the receiving cavity where the second opening is located.

2. The sound producing structure according to claim 1, wherein the magnetic circuit system further includes a yoke;

the first magnet is annular, and a through hole is disposed in a middle region of the first magnet;

gap exists between the first magnet and the second magnet to form the first magnetic channel; and one portion of the yoke abuts against a side of the first magnet facing the first diaphragm, another portion of the yoke is located in the through hole, a gap exists between the another part of the yoke and an inner side wall of the through hole to form the second magnetic channel, and the first magnetic channel and the second magnetic channel are isolated by the yoke.

3. The sound producing structure according to claim 2, wherein a gap exists between the magnetic conductive sheet and the yoke to form the first magnetic channel.

4. The sound producing structure according to claim 2, wherein the yoke is a T-shaped yoke and includes a horizontal portion and a vertical portion, the horizontal portion abuts against a side of the first magnet facing the first diaphragm, the vertical portion is located in the through hole, and the first magnetic channel and the second magnetic channel are isolated through the horizontal portion.

5. The sound producing structure according to claim 1, wherein the sound producing structure further comprises a first cover body and a second cover body;

the first cover body covers the first opening, the first diaphragm is located between the first cover body and the receiving cavity, and the first cover body is provided with a first sound outlet hole corresponding to the first diaphragm; and the second cover body covers the second opening, the second diaphragm is located between the second cover body and the receiving cavity, and the second cover body is provided with a second sound outlet hole corresponding to the second diaphragm.

6. The sound producing structure according to claim 5, wherein the first sound outlet hole is provided with a first protective net, and the second sound outlet hole is provided with a second protective net.

7. A terminal, comprising the sound producing structure according to claim 1.

8. The terminal according to claim 7, wherein the terminal further comprises a controller, the controller is electrically connected to the first voice coil and the second voice coil, respectively; and the controller is used to control the first voice coil or the second voice coil to operate according to an operating state of the terminal.

9. The terminal according to claim 7, wherein the terminal is a dual-face screen terminal.

* * * * *